US006379257B1

(12) United States Patent
Skleba et al.

(10) Patent No.: US 6,379,257 B1
(45) Date of Patent: Apr. 30, 2002

(54) AUTOMATIC BALL THROWER

(75) Inventors: Jim Skleba, Elk Grove; Kak Nanthavong, Elgin; Doug Jacobs, Fox River Grove; Roger Case, Genoa, all of IL (US)

(73) Assignee: American Bowling Congress, Inc., Greendale, WI (US)

( * ) Notice: Subject to any disclaimer, the term of this patent is extended or adjusted under 35 U.S.C. 154(b) by 0 days.

(21) Appl. No.: 09/579,445

(22) Filed: May 26, 2000

Related U.S. Application Data

(60) Provisional application No. 60/136,470, filed on May 28, 1999.

(51) Int. Cl.[7] ..... A63D 5/00

(52) U.S. Cl. ..... 473/107; 273/129 V

(58) Field of Search ..... 124/4, 6, 8; 273/108.54, 273/120 R, 129 R, 129 Q, 129 V, 129 W; 473/107

(56) References Cited

U.S. PATENT DOCUMENTS

| | | | |
|---|---|---|---|
| 1,273,301 A | | 7/1918 | Wood |
| 2,206,213 A | | 7/1940 | Weidemann |
| 2,280,331 A | | 4/1942 | Whittle |
| 2,490,802 A | | 12/1949 | Hanff, Jr. |
| 2,610,618 A | | 9/1952 | Huber |
| 3,142,292 A | | 7/1964 | Suchland |
| 3,364,787 A | | 1/1968 | Miller |
| 3,926,170 A | * | 12/1975 | Dixon |
| 6,019,095 A | | 2/2000 | Sommer et al. |

OTHER PUBLICATIONS

Experimental Reconstruction of a Medieval Trebuchet, by Peter Vemming Hansen, printed in Denmark, Acta Archaeologica vol. 63, 1992.*

* cited by examiner

*Primary Examiner*—William M. Pierce
(74) *Attorney, Agent, or Firm*—Michael Best & Friedrich LLP

(57) ABSTRACT

A bowling ball thrower includes a frame positionable adjacent to a bowling lane, a throwing arm pivotably attached to the frame, the throwing arm having a rest position and a pivoted position and including a ball-gripping mechanism for gripping a bowling ball, and a cocking arm pivotably attached to the frame, the cocking arm being selectively couplable to the throwing arm such that the cocking arm is pivotable with the throwing arm. A method for throwing a bowling ball includes holding the bowling ball with a ball thrower having a throwing arm and a cocking arm, and coupling the throwing arm to the cocking arm. The method also includes pivoting the throwing arm to a pivoted position to achieve a velocity, uncoupling the throwing arm from the cocking arm, and releasing the bowling ball such that the bowling ball moves at the velocity.

28 Claims, 4 Drawing Sheets

70
78
66
62
118
74
94
90
50
10
14
98
42
86
46
3
3
58
82
54
122
106
114
126
146
110
102

126
146
134
130
138
134
18

266
18
22
B
26
30
34
34
30
38

AUTOMATIC BALL THROWER

CROSS-REFERENCE APPLICATION

This application claims the benefit of U.S. Provisional Application No. 60/136,470, filed May 28, 1999.

FIELD OF THE INVENTION

The invention relates to an automatic ball thrower for delivering a bowling ball under controlled conditions.

BACKGROUND OF THE INVENTION

Various prior art devices have sought to simulate a bowler's motion in throwing a bowling ball. Some devices vary the velocity at which a ball is thrown, and some can impart a spin to the ball. Most of these have been associated with amusement devices.

SUMMARY OF THE INVENTION

One of the problems with the prior art devices is that the devices are limited in the number of variables they can simulate. For example, a device may be able to produce a spin in a bowling ball before it is released, but it cannot produce the spin consistently or at a known speed. Another problem with the prior art devices is that the devices do not offer repeatability of a given motion.

Because of the limited number of variables these devices can simulate, and because these devices cannot simulate a given variable consistently, none of these prior art devices can be use to test lane conditions, ball throwing conditions, or the bowling balls themselves. Some devices may be able to simulate more variables than other devices, but these devices tend to be very complex, virtually immovable due to their bulk and weight, and extremely expensive.

The automatic ball thrower of the present invention overcomes the shortfalls of prior art devices.

Specifically, the invention defines a bowling ball thrower including a frame positionable adjacent to a bowling lane, a throwing arm pivotably attached to the frame, the throwing arm having a rest position and a pivoted position and including a ball-gripping mechanism for gripping a bowling ball, and a cocking arm pivotably attached to the frame, the cocking arm being selectively couplable to the throwing arm such that the cocking arm is pivotable with the throwing arm.

The invention also defines a bowling ball thrower including a frame positionable adjacent to a bowling lane, a throwing arm pivotably attached to the frame, the throwing arm including a ball-gripping mechanism and having a rest position, and a gripper mechanism movably coupled to the frame, the gripper mechanism being operable to grip and maintain the throwing arm at a pivoted position from the rest position.

The invention also defines a method for throwing a bowling ball, the method including holding the bowling ball with a ball thrower having a throwing arm and a cocking arm, and coupling the throwing arm to the cocking arm. The method also includes pivoting the throwing arm to a pivoted position to achieve a velocity, uncoupling the throwing arm from the cocking arm, and releasing the bowling ball such that the bowling ball moves at the velocity.

The invention provides an apparatus and method for automatically throwing a bowling ball down a bowling lane to simulate a bowler's throw. The apparatus allows for variability of ball rotational speed, rotational axis, angle of delivery, loft, and velocity, which are the primary parameters a bowler influences. The apparatus can thus be used as a tool in improving a bowler's form. The apparatus can also be used to test lane conditions, the interaction between ball and lane, and bowling balls themselves. Among other factors, the slide-roll-hook phenomenon, ball-lane friction characteristics, flare, and angle of entry can all be studied to better understand how technology and the bowler are working together to throw the perfect shot.

One advantage of the present invention is that the apparatus can simulate each variable controllable by a human bowler.

Another advantage of the present invention is that the automatic ball thrower is compact, inexpensive, and easy-to-use. It will support research on bowling balls, lanes, and lane dressing patterns.

These and other features and advantages of the invention will become apparent to those skilled in the art upon review of the following detailed description of the preferred embodiment of the invention, which is given by way of example only, reference being made to the appended drawings.

Figure 1:
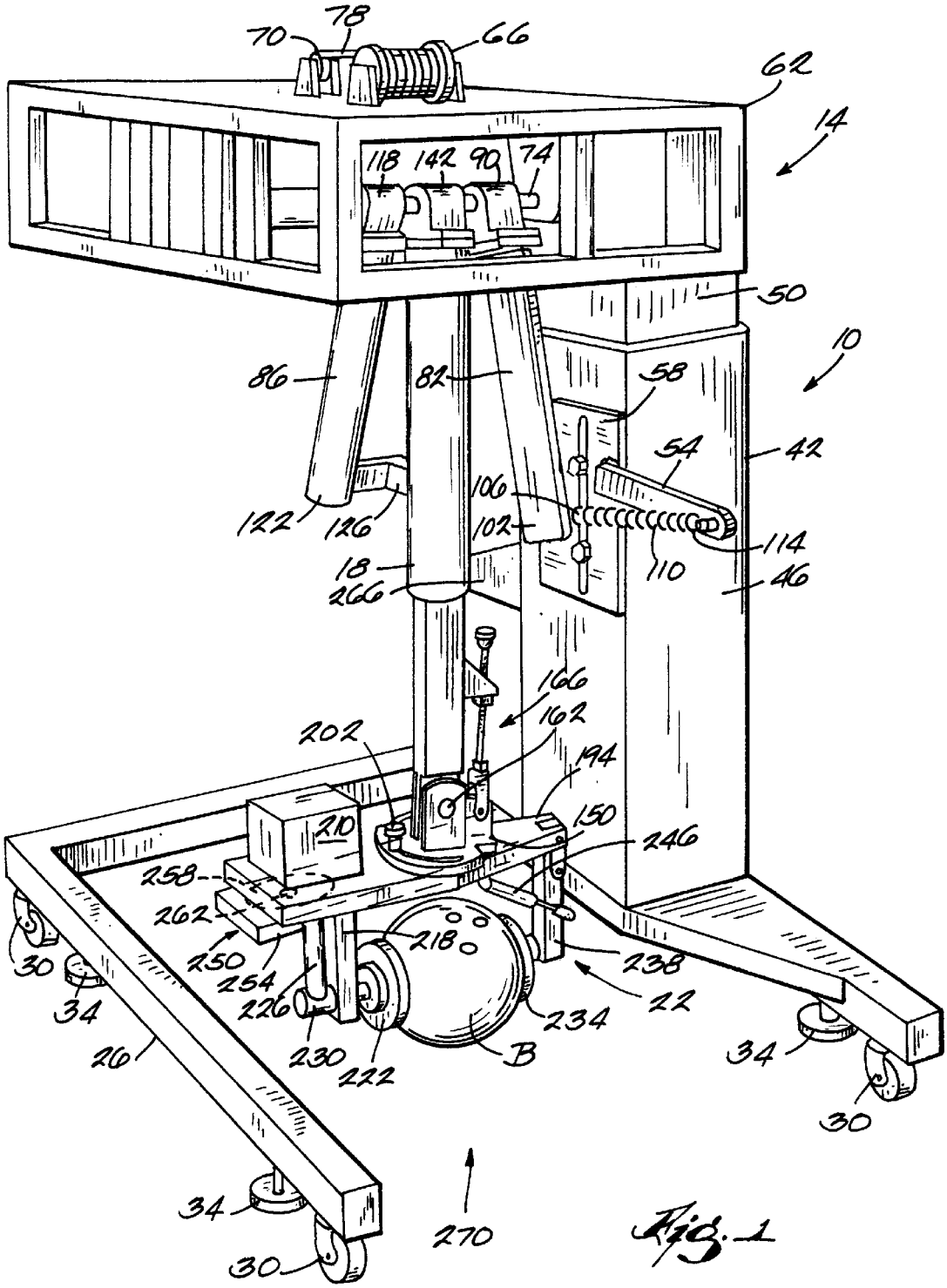
FIG. 1 is a perspective view of an automatic ball thrower embodying the invention.

Before one embodiment of the invention is explained in detail, it is to be understood that the invention is not limited in its application to the details of the construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DESCRIPTION OF THE PREFERRED EMBODIMENTS

FIG. 1 illustrates an automatic ball thrower 10 for consistently throwing a bowling ball B to test lane conditions, bowling ball performance, and bowler delivery methods. The thrower 10 can control ball rotational speed, rotational axis, angle of delivery, loft, and velocity, which are the primary parameters a bowler influences. The thrower 10 generally includes a frame 14 supporting a throwing arm 18 and a gripper assembly 22.

As illustrated in FIG. 1, the frame 14 includes a generally U-shaped base 26. The base 26 rests on retractable rollers 30 during movement. When the ball thrower 10 is in position for operation, the rollers 30 are retracted, leaving the base 26 resting on suction cup feet 34. A standard vacuum system of a pump and hoses (not shown) draws a vacuum within each suction cup foot 34 to establish a seal between each suction cup foot 34 and the bowling lane floor 38 (see FIG. 2) sufficient to anchor the ball thrower 10.

Mounted on the base 26 is a riser 42 including a lower riser section 46 and an upper riser section 50. The lower riser section 46 is mounted to the base 26. The upper riser section 50 is sized to fit within the lower riser section 46 and is slidably attached to the lower riser section 46. A standard pneumatic cylinder (not shown) is mounted between the base 26 and the bottom end of the upper riser section 50 within the lower riser section 46 such that the upper riser section 50 may be raised and lowered with respect to the lower riser section 46.

A spring anchor 54 is fixedly attached to a spring anchor plate 58, which is movably attached to the lower riser section 46 such that the spring anchor plate 58 and thus the spring anchor 54 may be manually adjusted up and down with respect to the lower riser section 46.

An upper frame section 62 is mounted to the top of the upper riser section 50. Mounted on the upper frame section 62 are a winch 66, a pulley 70, and a pivot axle 74. The winch 66 contains cable 78, which is preferably steel cable but which may be any suitable equivalent.

Figures 2, 3:
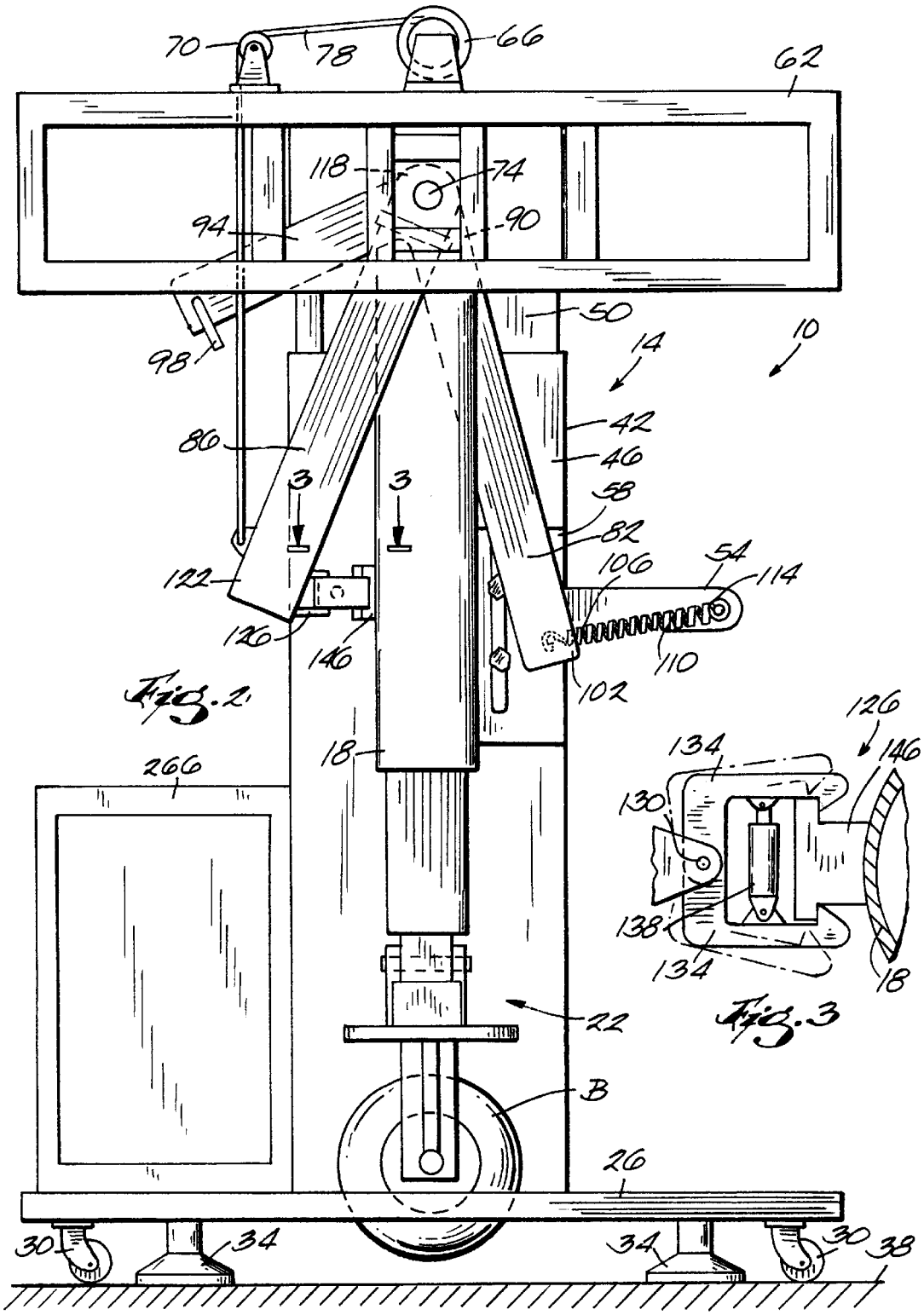
FIG. 2 is a cutaway view of the automatic ball thrower taken along line 2—2 of FIG. 1.
FIG. 3 is a cutaway view of a cocking arm gripper mechanism and a throwing arm cleat taken along line 3—3 of FIG. 2.

As illustrated in FIG. 2, the pivot axle 74 mounted within the upper frame section 62 supports three arms: a biasing or spring arm 82, a cocking arm 86, and the throwing arm 18. The spring arm 82 is pivotably attached to the pivot axle 74 at the pivot end 90 of the spring arm 82. The spring arm lever 94 is adjustably attached to the spring arm 82 near the pivot end 90 of the spring arm 82 such that the angle of the spring arm lever 94 with respect to the spring arm 82 may be varied. A contact peg 98 is attached to the spring arm lever 94 extending generally perpendicular to the spring arm lever 94.

A spring end 102 of the spring arm 82 is opposite the pivot end 90 of the spring arm 82. Attached to the spring end 102 of the spring arm 82 is a first end 106 of a spring 110. In alternate embodiments, any suitable device that stores sufficient energy may be used in the place of the spring 110. A second end 114 of the spring 110 is attached to the spring anchor 54 on the spring anchor plate 58. The spring anchor 54 may be adjusted vertically with respect to the lower riser section 46 to vary the position of the spring 110. As the spring arm 82 is rotated about the pivot axle 74 (clockwise as seen in FIG. 2), the spring 110 is stretched, thus storing energy.

The cocking arm 86 is also pivotably attached to the pivot axle 74 at a pivot end 118 of the cocking arm 86. Opposite the pivot end 118 of the cocking arm 86 is a gripper end 122 of the cocking arm 86. A gripper mechanism 126, best shown in FIG. 3, is attached to the gripper end 122 of the cocking arm 86. The gripper mechanism 126 includes an attachment pivot 130, which is mounted on the cocking arm 86, two fingers 134, which are movably attached to the attachment pivot 130, and a pneumatic cylinder 138. A pneumatic system controlled by the operator causes the fingers 134 to open and close as desired. In alternate embodiments, an electromagnetic system or another suitable system may be used to control the fingers 134.

As shown in FIG. 2, the cable 78 extends from the winch 66 over the pulley 70 and is attached near the gripper end 122 of the cocking arm 86. Operating the winch 66 such that the cable 78 is retracted causes the cocking arm 86 to be raised, or to pivot about the pivot axle 74 (clockwise in FIG. 2). Operating the winch 66 such that the cable 78 is extended causes the cocking arm 86 to be lowered. A standard first encoder (not shown) is also mounted on the pivot axle 74 to indicate the position of the throwing arm 18. The first encoder is preferably a disk encoder, but any suitable encoding system may be used.

Finally, the throwing arm 18 is also pivotably attached to the pivot axle 74 at a pivot end 142 of the throwing arm 18. The throwing arm 18 is free to pivot about the pivot axle 74 in either direction. For the purposes of description, backwards is the direction of pivoting or swing upwards and away from a substantially vertical rest position of the throwing arm 18. Forwards is the direction of pivoting or swing back toward the rest position.

The throwing arm 18 includes a cleat 146 mounted on the throwing arm 18 such that when the throwing arm 18 and the cocking arm 86 are generally vertical and aligned, the gripper mechanism 126 on the cocking arm 86 is aligned with the cleat 146 on the throwing arm 18. The cleat 146 is generally T-shaped in horizontal cross section, as shown in FIG. 3, and is sized such that the fingers 134 of the gripper mechanism 126 can releasably engage the cleat 146.

The throwing arm 18 also includes (see FIGS. 4 and 5) a gripper assembly 22 attached to an end of the throwing arm 18 opposite the pivot end 142 of the throwing arm 18. The gripper assembly 22 includes a gripper assembly attachment plate 150. One end of the attachment plate 150 includes a second attachment bracket 154. The end of the attachment plate 150 opposite the end including the second attachment bracket 154 includes a semicircular slot 158 with its concave side facing toward the throwing arm 18 (see FIG. 5). The attachment plate 150 is pivotably attached to the end of the throwing arm 18 such that the attachment plate 150 can pivot about a horizontal pivot 162. The amount of pivot in either direction is controlled by a vertical pivot control 166.

Figure 4:
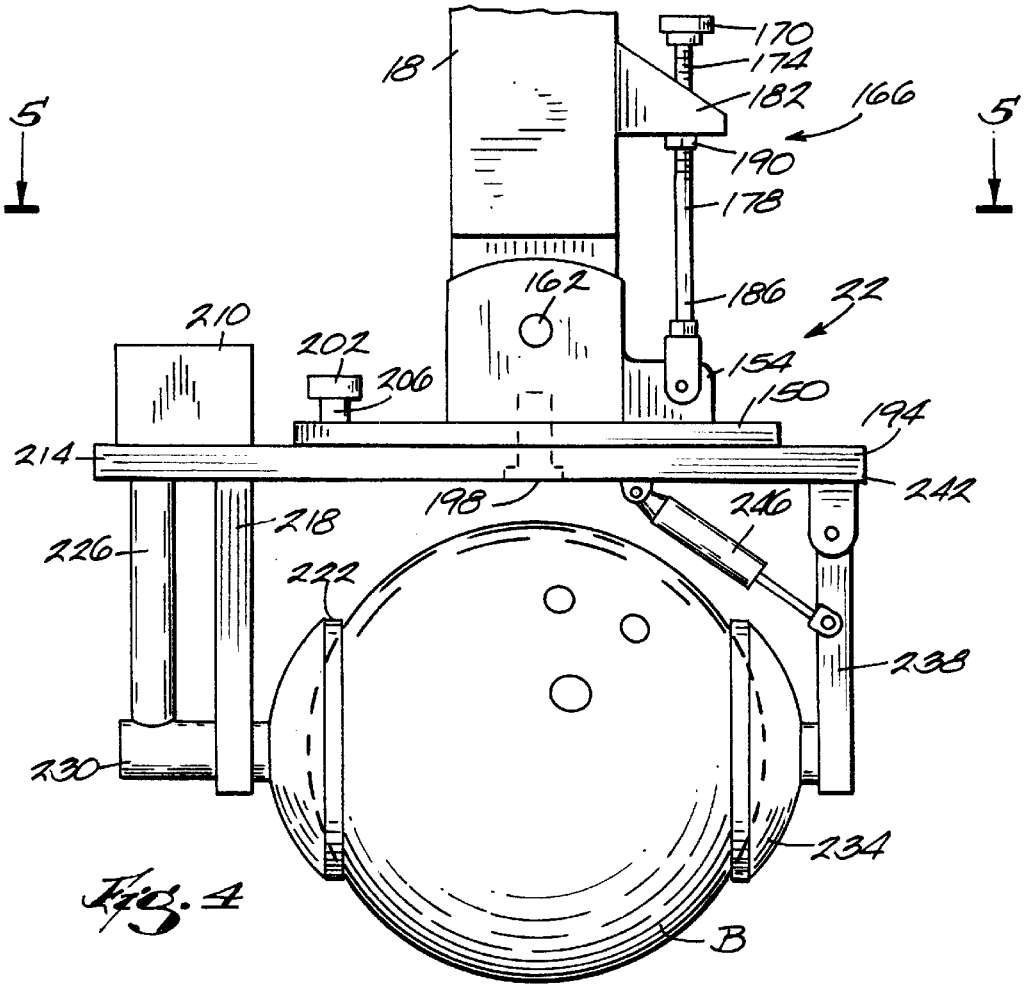
FIG. 4 is a partial elevation view of a gripper assembly for the automatic ball thrower.
Figure 5:
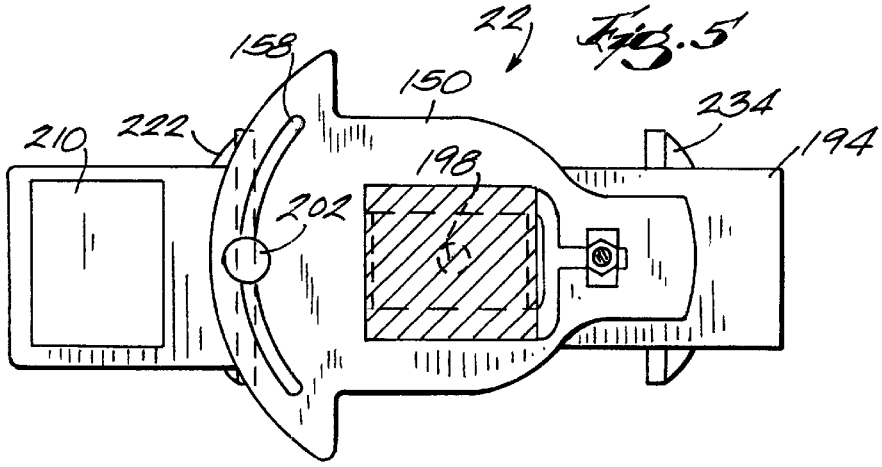
FIG. 5 is a cutaway view of the gripper assembly taken along line 5—5 of FIG. 4.
Figure 6:
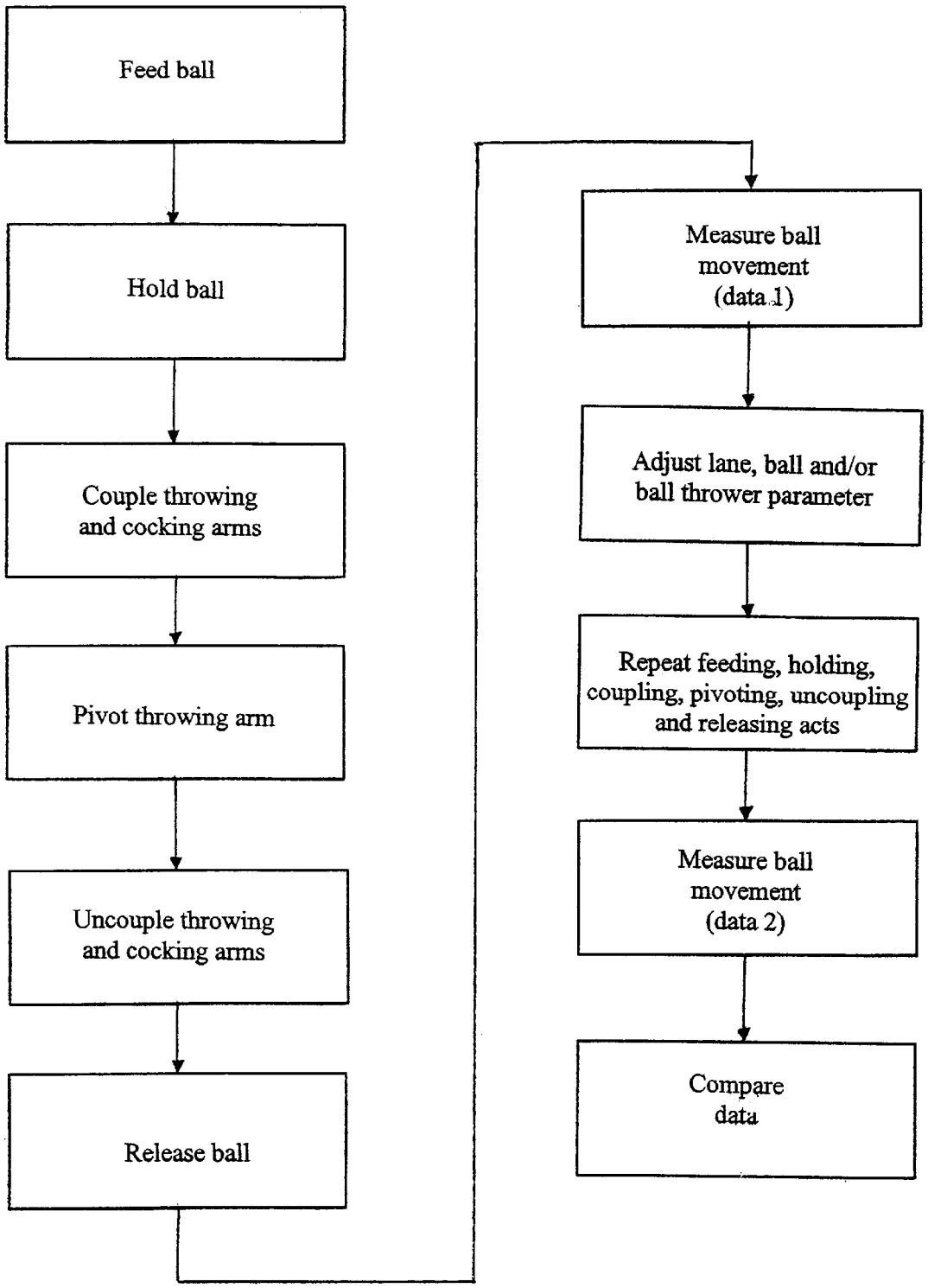
FIG. 6 is a flow chart illustrating a method for throwing a bowling ball.

As shown in FIG. 4, the vertical pivot control 166 includes a first thumbwheel 170 mounted on a top end 174 of a threaded rod 178. The threaded rod 178 is supported adjacent the top end 174 by a first attachment bracket 182 mounted on the throwing arm 18 above the pivot point 162. The threaded rod 178 is pivotably supported at a bottom end 186 by the second attachment bracket 154 mounted on the attachment plate 150. Turning the threaded rod 178 by use of the first thumbwheel 170 causes the rod 178 to move up or down relative to the first attachment bracket 182. For example, if the first thumbwheel 170, and thus the rod 178, are turned clockwise, the rod 178 will move down, causing the attachment plate 150 to pivot around the pivot point 162 in a clockwise direction (in FIG. 4). Once the desired amount of pivot of the attachment plate 150 is achieved, a nut 190 located on the threaded rod 178 between the bottom end 186 and the first attachment bracket 182 is tightened against the first attachment bracket 182, locking the threaded rod 178 and thus the attachment plate 150 in place.

The gripper assembly 22 also includes a gripper frame 194 rotatably attached to the attachment plate 150 at a pivot point 198, enabling the gripper frame 194 to rotate in a generally horizontal plane about the pivot point 198. The extent of horizontal pivoting of the gripper frame 194 allowed is controlled by a second thumbwheel 202 mounted on a bolt 206. The bolt 206 extends through the slot 158 in the attachment plate 150 into a threaded hole in the gripper frame 194. When the gripper frame 194 is rotated to its desired position, the second thumbwheel 202, and thus the bolt 206, are turned clockwise to tighten the second thumbwheel 202 against the attachment plate 150 and the attachment plate 150 against the gripper frame 194, thus locking the attachment plate 150 and the gripper frame 194 together and preventing further rotation of the gripper frame 194.

The gripper assembly 22 also includes a servo motor 210 (schematically illustrated) mounted on a first end 214 of the gripper frame 194. Mounted within the servo motor 210 is a standard second encoder (not shown) that sends an electronic signal indicating the position of a bowling ball B as the ball B spins within the gripper assembly 22.

A first frame leg 218 is also attached to the gripper frame 194 at the first end 214. A driving ball cup 222 is rotatably mounted on the first frame leg 218. A drive shaft 226 with a right-hand component 230 is connected between the servo motor 210 and the driving ball cup 222. A driven ball cup 234 is rotatably mounted on a second frame leg 238, which is pivotably attached to a second end 242 of the gripper frame 194 such that the second frame leg 238 can move toward and away from the first frame leg 218. Movement of the second frame leg 238 is preferably controlled by a pneumatic cylinder 246 attached between the second frame leg 238 and the gripper frame 194. This arrangement allows the gap between the driving and the driven ball cups 226, 234 to be opened to accommodate the ball B. The gap can also be closed, thus capturing the ball B between the ball cups 226, 234. The ball cups 226, 234 can be lined with rubber pads or any other suitable material to assist the ball cups 226, 234 in capturing and holding the ball B. The gripper assembly 22 can also be equipped with a mechanical lock (not shown) to ensure that the ball B remains captured between the ball cups 226, 234 until the desired release point is reached. In an alternate embodiment, both the first and second frame legs 218, 238 may be movable.

Also mounted on the base 26 is (see FIG. 1) a feeder arm assembly 250. The feeder arm assembly 250 includes a feeder arm 254 (connected to the base 26, as illustrated in dashed lines in FIG. 1), a ball cup 258 with a central vacuum port 262, and a pneumatic cylinder (not shown) for raising and lowering the feeder arm 254.

Also mounted on the base 26 is a control panel 266. This control panel 266 contains the standard pneumatic, vacuum, and electronic controls (not shown) necessary to operate the various pneumatic, vacuum, and electronic components of the ball thrower 10. Pneumatic and vacuum hoses and electronic wires that run from the control panel 266 to various components are not shown for reasons of simplicity. Supplying and controlling air to pneumatic cylinders, a vacuum to vacuum systems, and electricity to electronic components, are accomplished by conventional means. While the device is illustrated with pneumatic devices, other suitable devices may be used. For example, hydraulic systems or any other suitable system may replace the pneumatic systems. The control panel 266 also contains controllers (not shown) to coordinate the various operations of the ball thrower 10.

In operation, the automatic ball thrower 10 is staged at the head of a bowling lane selected for testing. The ball thrower 10 is oriented with an open end 270 of the base 26 toward a bowling lane. Once the ball thrower 10 is in its final position, the rollers 34 are retracted so that the ball thrower 10 rests on suction cup feet 38. A vacuum pump (not shown) is operated to create a vacuum between the suction cup feet 38 and the floor 42, thus removably but securely anchoring the thrower 10 to the floor 42.

A bowling ball B is selected for testing and is placed in the ball cup 258 when the feeder arm 254 is in its lowered position. A vacuum is applied to the central vacuum port 262 of the ball cup 258, thus securing the ball B within the ball cup 258. The feeder arm 254 is then raised, thus properly positioning the ball B for testing.

The ball delivery conditions to be tested are determined, including the ball throw variables of ball rotational speed, rotational axis, angle of delivery, loft, and velocity. The ball rotational speed is the speed at which the ball rotates about any given axis, and is typically measured in revolutions per minute. The operator sets the desired ball rotational speed by entering the speed setpoint value in the computer in the control panel 266. The computer then instructs the servo motor 210 to turn the driving cup 222 at the given speed.

The ball rotational axis is the direction of the axis about which the ball rotates. The rotational axis of the ball can affect the ball's path of travel because most balls are not homogeneous; most balls have finger holes on one side and a weight located within the ball. These non-homogeneities cause the ball to roll differently about different axes. Two factors determine the ball rotational axis. First, the orientation of the ball B in the ball cup 258 of the feeder arm 254 determines in what orientation the gripper cups will hold the ball B. Second, the spin angle of the gripper assembly 22 with the ball B in place is determined by manually setting the pivot position of the gripper assembly 22 using the vertical pivot control 166 as described above. By controlling the orientation of the ball B in the ball cup 258 and thus within the gripper assembly 22 and by properly setting the gripper assembly 22 vertical pivot, the ball rotational axis can be controlled. The second encoder within the servo motor 210 monitors the position the bowling ball B as it spins so that the ball B can be released when it is in a predetermined position with respect to its non-homogeneities.

The angle of delivery is the angle with respect to the longitudinal axis of the bowling lane at which the ball is released. The angle of delivery is changed largely to simulate right- and left-handed bowlers. The ball angle of delivery is manually set by loosening the second thumbwheel 202, rotating the gripper frame 194 about the pivot point 198 to the desired angle, and then tightening the second thumbwheel 202 to lock the gripper frame 194 in place.

The ball loft is essentially the height above the lane at which the ball is released. Some bowlers release the ball while the ball is essentially in physical contact with the lane, while other bowlers tend to release the ball when the ball is above the lane, resulting in a vertical component of the ball's path of travel. In extreme cases, the bowler appears to be tossing the ball. Ball loft is set by the operator in the computer in the control panel 266. Based on the setpoint chosen by the operator, the first encoder connected to the pivot axle 74 determines the position of the throwing arm 18 as it swings forward. When the position of the throwing arm 18 equals the setpoint, the ball B is released, which is explained in more detail below. Ball loft can also be affected by the position of the upper riser section 50 with respect to the lower riser section 46. An increase in height of the upper riser section will raise the upper frame section 62 and thus the throwing arm 18.

Finally, ball velocity is simply the translational speed at which the ball is traveling at the point of release and is measured in miles per hour. Ball velocity is also set by the operator in the computer in the control panel 266. Generally, the higher the desired velocity, the farther back the throwing arm 18 is pulled in its backswing.

For any given test, the attachment between the spring arm 82 and the spring arm lever 94 will not be adjusted. Thus, for that test, the spring arm 82 and the spring arm lever 94 will move as one unit.

Once the ball thrower 10 is set properly to effect the desired throw, the operator begins the test by operating the computer on the control panel 266. The cocking arm gripper fingers 134 open and the cocking arm 86 is lowered from its raised, disconnected position by running the winch 66 to let out cable 78. The cocking arm 86 is lowered until it contacts the throwing arm 18. The gripper fingers 134 close about the cleat 146, thus causing the cocking arm 86 to become detachably affixed to the throwing arm 18. The direction of winch 66 direction is reversed, causing the cocking arm 86/throwing arm 18 assembly to be pulled back and up into a backswing. This motion stops when the gripper assembly 22 is aligned with the ball B resting in the ball cup 258 on the feeder arm 254.

The driven cup 234 of the gripper assembly 22 closes on the ball B, thus capturing the ball B between the driving cup 222 and the driven cup 234. The vacuum to the ball cup 258 is turned off, thus releasing the ball B from the ball cup 258. The cocking arm 86/throwing arm 18 assembly is then pulled further into the backswing until the backswing necessary to produce the desired ball velocity is reached.

For higher ball velocities requiring greater backswings, the throwing arm 18 comes into contact with the contact peg 98 of the spring arm lever 94. If the backswing continues from that point, the throwing arm 18 will push the contact peg 98 and thus the spring arm lever 94. Because the spring arm lever 94 is fixedly attached to the spring arm 82, moving the spring arm lever 94 will cause the spring arm 82 to rotate about the pivot end 90 (clockwise in FIG. 2). As the spring arm 82 rotates, the spring 110 attached to the spring end 102 extends, thus storing energy to be used in the ball throw.

When the cocking arm 86/throwing arm 18 assembly reaches the apex of the backswing, the operator begins the test when ready by pressing the start button on the control panel 266. The servo motor 210 drives the drive shaft 226, which in turn drives the driving ball cup 222, thus turning the bowling ball B and the driven ball cup 234 until the ball B reaches the desired rotational speed. The gripper fingers 134 then open, releasing the cleat 146 and thus the throwing arm 18. Gravity pulls the throwing arm 18 downward and forward (counter-clockwise in FIG. 2). For higher ball velocities, if the spring arm 82 has been engaged, the spring 110 also pulls the throwing arm 18 forward by way of the spring arm 82, spring arm lever 94, and contact peg 98.

When the throwing arm 18 reaches the point in its swing corresponding to the desired ball loft as described above, the first encoder indicates this position to the computer, causing the computer to open the driven cup 234 of the gripper assembly 22, thus releasing the ball B. The ball B will be thrown down the bowling lane with the desired rotational speed, rotational axis, angle of delivery, loft, and velocity. The motion of the ball B with respect to the lane and the pins can be monitored by known methods to accomplish different tasks.

Without any further adjustments, the identical throw can be repeated indefinitely using the same ball B and the same lane to eliminate ball throw conditions as variables in testing lane conditions. Subtle differences in lane conditions can be tested for their effects on the motion of the ball B.

The effect of altering any given ball throw condition, such as ball rotational speed, loft, etc. can be tested by holding the other ball throw condition variables constant, and by holding lane conditions constant. In this way, using the ball thrower 10 to imitate the bowler's delivery and altering whatever variables are within the bowler's control can be used to optimize a bowler's delivery.

Finally, bowling balls themselves can be tested by holding all of the ball throw and lane condition variables constant and throwing different balls.

Various features of the invention are set forth in the following claims.

We claim:

1. A bowling ball thrower comprising:

a frame positionable adjacent to a bowling lane;

a throwing arm pivotably attached to the frame, the throwing arm having a rest position and a pivoted position and including a ball-gripping mechanism for gripping a bowling ball; and a cocking arm pivotably attached to the frame, the cocking arm being selectively couplable to the throwing arm such that the cocking arm is pivotable with the throwing arm from the rest position to the pivoted position, the cocking arm being uncoupled from the throwing arm to allow the throwing arm to move from the pivoted position toward the rest position to throw the ball.

2. The thrower of claim 1, further comprising a gripper mechanism attached to one of the throwing arm and the cocking arm such that the throwing arm and the cocking arm are selectively coupled and uncoupled.

3. The thrower of claim 1, further comprising a drive mechanism connected between the cocking arm and the frame operable to pivot the cocking arm.

4. The thrower of claim 1, further comprising a feeder assembly attached to the frame for feeding the ball to the ball-gripping mechanism, wherein the feeder assembly feeds the ball to the ball-gripping mechanism after the throwing arm is pivoted from the rest position.

5. The thrower of claim 4, wherein the feeder assembly includes a feeder arm supported by the frame and selectively supporting the ball in a position to be gripped by the ball-gripping mechanism.

6. The thrower of claim 5, wherein the feeder arm is movable between a feeding position, in which the ball is positioned to be gripped by the ball-gripping mechanism, and a non-feeding position.

7. The thrower of claim 5, wherein the feeder arm releasably holds the ball.

8. The thrower of claim 1, further comprising a biasing mechanism connected to the frame and couplable to the throwing arm, the biasing mechanism including a biasing arm selectively engageable with the throwing arm and a biasing means connected between the biasing arm and the frame to apply a biasing force to the biasing arm.

9. The thrower of claim 8, wherein the throwing arm is selectively engageable with the biasing arm to bias the throwing arm from the pivoted position toward the rest position.

10. The thrower of claim 9, wherein the throwing arm engages the biasing arm as the throwing arm is pivoted to the pivoted position, and wherein the throwing arm disengages the biasing arm as the throwing arm pivots from the pivoted position toward the rest position to throw the ball.

11. A bowling ball thrower comprising:

a frame positionable adjacent to a bowling lane;

a throwing arm pivotably attached to the frame, the throwing arm including a ball-gripping mechanism and having a rest position; and a gripper mechanism movably coupled to the frame, the gripper mechanism being operable to grip the throwing arm, move the throwing arm to a pivoted position from the rest position, and maintain the throwing arm at the pivoted position, the gripper mechanism being operable to release the throwing arm to allow the throwing arm to pivot from the pivoted position toward the rest position to throw the ball.

12. The thrower of claim 11, further comprising a cocking arm pivotably attached to the frame, the gripper mechanism being attached to one of the throwing arm and the cocking arm such that the throwing arm and the cocking arm are coupled to move the throwing arm to the pivoted position and such that the throwing arm and the cocking arm are uncoupled to allow the throwing arm to move from the pivoted position toward the rest position to throw the ball.

13. The thrower of claim 12, further comprising a drive mechanism connected between the cocking arm and the frame operable to pivot the cocking arm.

14. The thrower of claim 11, further comprising a feeder assembly attached to the frame for feeding a ball to the ball-gripping mechanism.

15. The thrower of claim 14, wherein the feeder assembly feeds the ball to the ball-gripping mechanism when the throwing arm is pivoted from the rest position.

16. The thrower of claim 11, further comprising a biasing mechanism including a spring arm pivotably connected to the frame and engageable with the throwing arm, and a spring connected between the spring arm and the frame to bias the throwing arm from the pivoted position toward the rest position when the spring arm and the throwing arm are engaged.

17. A method for throwing a bowling ball, the method comprising the acts of:

providing a ball thrower including a frame, a throwing arm pivotably connected to the frame and a cocking arm pivotably connected to the frame;

holding the bowling ball with the throwing arm;

coupling the throwing arm to the cocking arm;

pivoting the throwing arm to a pivoted position to achieve a velocity;

uncoupling the throwing arm from the cocking arm; and releasing the bowling ball such that the bowling ball moves at the velocity.

18. The method of claim 17, further comprising, after the releasing act, the act of measuring movement of the bowling ball to generate a first set of performance data.

19. The method of claim 18, further comprising the acts of:

adjusting a characteristic of a bowling lane;

repeating the holding, coupling, pivoting, uncoupling, and releasing acts; and measuring the movement of the bowling ball on the bowling lane to generate a second set of performance data.

20. The method of claim 19, further comprising the act of comparing the first and second sets of performance data.

21. The method of claim 17, wherein the releasing act further includes releasing the ball such that the ball moves with a rotational speed, axis of rotation, delivery angle, and loft.

22. The method of claim 17, further comprising the acts of, after the releasing act:

holding the ball with the ball thrower;

coupling the throwing arm to the cocking arm;

pivoting the throwing arm to a second pivoted position to achieve a second velocity;

uncoupling the throwing arm from the cocking arm; and releasing the bowling ball such that the bowling ball moves at the second velocity.

23. The method of claim 22, wherein the releasing act further includes releasing the ball such that the ball moves at at least one of a second rotational speed, a second axis of rotation, a second delivery angle, and a second loft.

24. The method of claim 17, wherein the providing act includes providing a ball-gripping mechanism on the throwing arm and a feeder assembly connected to the frame and including a feeder arm, wherein the method further comprises, before the holding act, the act of feeding the ball to the ball-gripping mechanism.

25. The method of claim 24, wherein the feeding act includes positioning the ball in an orientation relative to the feeder arm.

26. The method of claim 25, further comprising, after the releasing act, the act of feeding a ball to the ball-gripping mechanism including positioning the ball in a second orientation relative to the feeder arm.

27. The method of claim 26, further comprising, after the second-mentioned feeding act, the acts of:

holding the ball with the ball-gripping mechanism;

coupling the throwing arm to the cocking arm;

pivoting the throwing arm to a pivoted position to achieve the velocity;

uncoupling the throwing arm from the cocking arm; and releasing the bowling ball such that the bowling ball moves at the velocity.

28. The method of claim 27, further comprising:

after the first-mentioned releasing act, the act of measuring movement of the ball to generate a first set of performance data;

after the second-mentioned releasing act, the act of measuring movement of the ball to generate a second set of performance data; and comparing the first set of performance data and the second set of performance data.

* * * * *